United States Patent [19]

Hatada et al.

[11] 4,365,667

[45] Dec. 28, 1982

[54] HEAT EXCHANGER

[75] Inventors: Toshio Hatada; Takao Senshu; Akira Arai; Fumio Harada, all of Shimizu; Atsushi Matsuzaki, Tokyo; Hajime Futawatari, Shimizu; Yutaka Imaizumi, Yaizu; Sumiyoshi Takeda, Shimizu, all of Japan

[73] Assignee: Hitachi, Ltd., Tokyo, Japan

[21] Appl. No.: 118,723

[22] Filed: Feb. 5, 1980

[30] Foreign Application Priority Data

Feb. 7, 1979 [JP] Japan ..... 54/12263

[51] Int. Cl.[3] ..... F28F 1/22

[52] U.S. Cl. ..... 165/152; 29/157.3 B; 165/181

[58] Field of Search ..... 165/151–153, 165/170, 180, 181, 11

[56] References Cited

U.S. PATENT DOCUMENTS

| | | | |
|---|---|---|---|
| 2,789,797 | 4/1957 | Simbelaar | 165/170 |
| 3,135,320 | 6/1964 | Forgo | 165/151 |
| 3,397,741 | 8/1968 | Gunter | 165/152 |
| 3,695,347 | 10/1972 | Chartet | 165/152 |

FOREIGN PATENT DOCUMENTS

| | | | |
|---|---|---|---|
| 1521499 | 3/1968 | France | 165/151 |

*Primary Examiner*—William R. Cline
*Assistant Examiner*—Theophil W. Streule, Jr.
*Attorney, Agent, or Firm*—Antonelli, Terry & Wands

[57] ABSTRACT

In a cross finned tube heat exchanger including a multiplicity of side-by-side fin plates, and a plurality of heat transfer tubes extending through the fin plates at least in one row to provide a serpentine flow passage for a heat transfer medium which exchanges heat with another heat transfer medium flowing across the surfaces of the fin plates, a multiplicity of stepped louvers are formed on the wall of each fin plate between the adjacent heat transfer tubes of the same row. The stepped louvers each extending in a direction at right angles to the direction of air flow across the surfaces of the fin plates include at least one tilting rise wall and may differ from one another in shape depending on their positions. The stepped louvers on each fin plate may be arranged in the form of waves or uniform in height with respect to the direction in which each fin plate extends. The adjacent stepped louvers have edges varying in vertical positions.

8 Claims, 12 Drawing Figures

HEAT EXCHANGER

BACKGROUND OF THE INVENTION

This inventioon relates to heat exchangers utilizing air flow suitable for use with air conditioners, refrigerating apparatus, dehumidifiers and the like, and more particularly it is concerned with a cross finned tube exchanger including a multiplicity of substantially parallel, closely spaced fin plates formed with stepped louvers thereon.

A cross finned tube heat exchanger essentially comprises a multiplicity of fin plates of a suitable area formed of thin sheet metal stock, such as aluminum, and having a plurality of aligned openings formed therein, and a plurality of heat transfer tubes inserted in the aligned openings in the fin plates substantially parallel and closely spaced apart from one another with a pitch of several millimeters. After insertion in the aligned openings, the heat transfer tubes are expanded into intimate contact with the fin plates and connected at their ends by U-shaped bent tube portions to form a bundle of heat transfer tubes of a suitable number arranged in serpentine form to provide a passage for a heat transfer medium subjected to heat exchange with another heat transfer medium flowing across the surfaces of the fin plates. More specifically, cold water, hot water or a refrigerant flows through the heat transfer tubes while air flows across the surfaces of the fin plates substantially parallel to one another, so that the two fluids exchange heat with one another through the walls of the tubes and the fin plates.

The cross finned tube heat exchanger of the aforesaid construction offers the advantages that it has a relatively large heat transfer area and a relatively compact size. However, in this type of heat exchanger, some problems are raised which will be described hereinafter.

An overall heat transfer coefficient of a heat exchanger is determined by heat transfer between a heat transfer medium flowing through the heat transfer tubes and the walls of the heat transfer tubes and heat transfer between currents of external air and the surfaces of the fins. However, the latter heat transfer being lower in degree than the former heat transfer, the overall heat transfer coefficient is largely determined by the heat transfer action of the currents of external air flowing across the surfaces of the fins.

Boundary layers of air are formed on the surfaces of fins arranged substantially parallel to one another and in the currents of external air flowing across the surfaces, and such boundary layers cause a reduction in heat transfer characteristics as their thicknesses become large. The thickness of each boundary layer of air currents or temperature boundary layer becomes greater in going from the upstream end of each fin toward the downstream end of the fin until the temperature boundary layers formed on the surfaces of the two adjacent fins merge into one in a position spaced apart a certain distance from the upstream end of each fin toward the downstream end of the fin. Thus the heat transfer occurring between the surfaces of the fin plates and external air is reduced in degree in going from the upstream end toward the downstream end of the fin plates, so that the surface of each fin has a low heat transfer coefficient on an average.

As described hereinabove, a cross finned tube heat exchanger using flat fin plates has a low heat transfer coefficient because of the presence of boundary layers formed on the surfaces of the fin plates. It is effective to prevent formation of the boundary layers to increase the heat transfer coefficient of the surface of each fin plate through which heat transfer occurs between the two heat transfer mediums.

Various proposals have been made to improve the fin plates in view of the foregoing. In U.S. Pat. Nos. 3,380,518, 3,397,741 and 3,438,433, a multiplicity of flat-plate louvers are formed on each of a multiplicity of flat fin plates and arranged in a direction at right angles to the currents of air flow across the surfaces of the fin plates. In these heat exchangers, when air flows across the surfaces of the fin plates, a temperature boundary layer is formed on the surface of each fin plate. The temperature boundary layer ceases its growth at the rear end of each louver and its thickness is greatly reduced by the effect of the principal air current until the temperature boundary layer reaches the next following louver. Because of the development of this air flow pattern on the surface of the fin plate, the leading edge effect of the louver is increased so that the air current is cut by the front edge of the louver and the fins with louvers have a relatively high heat exchange coefficient as compared with the flat fins. It is to be noted that the louvers themselves are flat in shape in these heat exchangers.

Japanese Utility Model Application Laid-open No. 17867/78 discloses a heat exchanger comprising fins bent into convoluted form in the flow direction of external air so that ridges and valleys are formed to extend in a direction at right angles to the external air flow, and a multiplicity of louvers arranged in the same direction as the ridges on the fins in such a manner that they are elevated from the surfaces of the fins and parallel thereto.

In this heat exchanger, the turbulent flow promoting function of the convoluted fins and the leading edge effect of the louvers to cut the air currents are combined to increase the heat exchange efficiency of the fins. It is to be noted, however, that the louvers themselves are flat in shape.

U.S. Pat. No. 3,796,258 discloses a heat exchanger including convoluted fin plates formed with a plurality of air passage openings. This heat exchanger also increases the heat exchange efficiency by destroying the boundary layers of air currents formed on the surfaces of the fin plates and by forming turbulence in the air currents flowing across the surfaces of the fin plates. This heat exchanger has no louvers.

The prior art referred to hereinabove provides an increase in the heat exchange efficiency. However, a further increase in heat exchange efficiency is desired in cross finned tube heat exchangers. The provision of louvers reduces the strength of the fin plates, particularly the rigidity of fin plates longitudinally of the louvers because of a multiplicity of cuts made therein. In view of the recent tendency to reduce the thickness of the fin plates and with a view to facilitating assembling of heat exchangers, the reduction in the rigidity of the fin plates constitutes a serious defect. It is also earnestly desired that the fin plates be increased in strength.

SUMMARY OF THE INVENTION

A principal object of the present invention is to provide a heat exchanger wherein the efficiency of heat exchange occurring between a multiplicity of fin plates arranged substantially parallel to one another and external air flowing across the fin plates is greatly increased.

Another object of the present invention is to provide a heat exchanger wherein the strength of the fin plates longitudinally of the louvers is increased in spite of the presence of the louvers and wherein a reduction in the thickness of fin plates and facilitating of assembling of the heat exchanger are achieved as the result of the increased strength of the fin plates.

Still another object of the present invention is to provide a heat exchanger formed with a multiplicity of louvers of the desired configuration on each of the fin plates of the heat exchanger.

These objects are accomplished according to the invention in preferred embodiments thereof wherein a multiplicity of louvers of novel constructional forms are provided to each of a multiplicity of fin plates arranged in closely spaced and substantially parallel relation and formed with aligned holes for receiving a plurality of heat transfer tubes. The louvers are formed by making a plurality of cuts in the wall of each fin plate interposed between the adjacent heat transfer tube receiving holes forming a row of such holes, the cuts extending substantially parallel to the direction at right angles to the flow direction of air between the adjacent fin plates to provide fine strips which are bent in stepped fashion, the stepped louvers including at least one inclined rise portion and having edges which differ in height from the edges of the adjacent louvers. The heat transfer tubes are passed through the aligned holes and brought into intimate contact with the fin plates to provide a finned tube heat exchanger.

When air flows into the heat exchanger, the air is divided into a multiplicity of currents which flow through air passages formed between the adjacent fin plates. Each air current flows through the stepped louvers, but the air flow is disturbed by the bent portions of the stepped louvers. The air flow occurring along the surface of each stepped louver forms a temperature boundary layer which is very thin because its development is inhibited. Thus, the air currents flowing between the adjacent fin plates are disturbed by the stepped louvers into turbulent air currents and the temperature boundary layer formed on the surface of each louver is very thin, so that heat exchange occurs vigorously between the heat transfer medium flowing through the heat transfer tubes and the heat transfer medium flowing between the adjacent fin plates and the heat exchange efficiency of the heat exchanger is greatly increased.

The wall of each fin plate interposed between the adjacent two heat transfer tubes of a row of such tubes is bent stepwise in a direction at right angles to the direction of the row of heat transfer tubes to provide stepped louvers each formed with at least two ridges, so that the strength of each fin plate or the flexural strength (rigidity) of the fin plate longitudinally of the louvers is increased. This allows the thickness of each fin plate to be reduced to thereby reduce material cost and permit assembling of the heat exchanger to be facilitated. Even if the fin plates have a great longitudinal dimension, a multiplicity of them can be held in position in predetermined spaced relation, and the efficiency with which the heat transfer tubes are inserted in the aligned holes in the parallel fin plates and expanded into intimate contact with the fin plates can be increased.

In one embodiment, the stepped louvers formed on each fin plate are bent and have ridges between their walls, and are elevated in bridge fashion in suitable positions to provide a group of stepped louvers arranged in the form of waves with respect to the direction in which the fin plate extends. In another embodiment, the bent and ridged stepped louvers are uniform in height with respect to the direction in which the fin plate extends. The group of stepped louvers arranged in the form of waves include louvers constituting the top and bottom of the wave form which each have walls arranged symmetrically. In still another embodiment, the stepped louvers are not bent to form ridges but are curved to provide stepped louvers of curved form.

DESCRIPTION OF THE PREFERRED EMBODIMENTS

Figure 1:
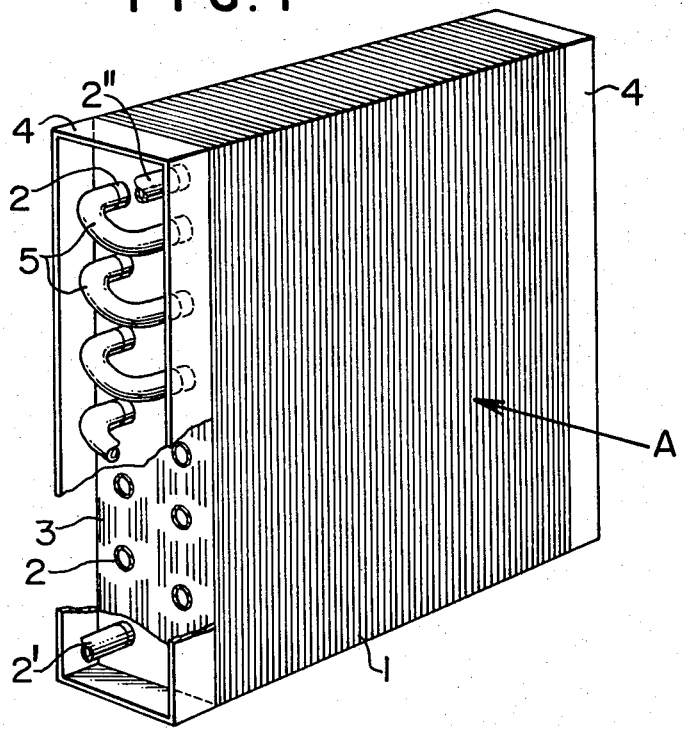
FIG. 1 is a perspective view of the heat exchanger including stepped louvers formed on the fin plates according to the present invention.

FIG. 1 shows one embodiment of the invention wherein fin plates 1, formed of thin sheet metal stock, such as aluminum sheet, are formed with a plurality of openings for passing heat transfer tubes 2 therethrough. A multiplicity of stepped louvers 3 are formed on the wall of each of the fin plates 1 interposed between the adjacent heat transfer tube receiving openings. A multiplicity of fin plates 1 are arranged substantially parallel to one another and spaced from one another by several millimeters, and a side plate 4 is located on either side of the multiplicity of fin plates 1. The heat transfer tubes 2 passing through the openings are expanded into intimate contact with the fin plates 1, and connected together at their ends by U-shaped bent tube portions 5 to provide a bundle of heat transfer tubes in serpentine form connected to an inlet pipe 2′ and an outlet pipe 2″ at opposite ends. The serpentine heat transfer tube bundle provides a passage for a heat transfer medium.

A heat transfer medium, such as a refrigerant, cold water or hot water, flows through the inlet pipe 2′ into the heat transfer tubes 2 and is discharged through the discharge pipe 2″ to outside. Meanwhile another heat transfer medium which is typically air flows in the direction of an arrow A at a suitable flow velocity between the two adjacent fin plates 1, so that the two heat transfer mediums exchange heat through the walls of the heat transfer tubes 2 and the fin plates 1. The fin plate 1 formed with the stepped louvers 3 as described hereinabove will now be described in detail.

Figure 2:
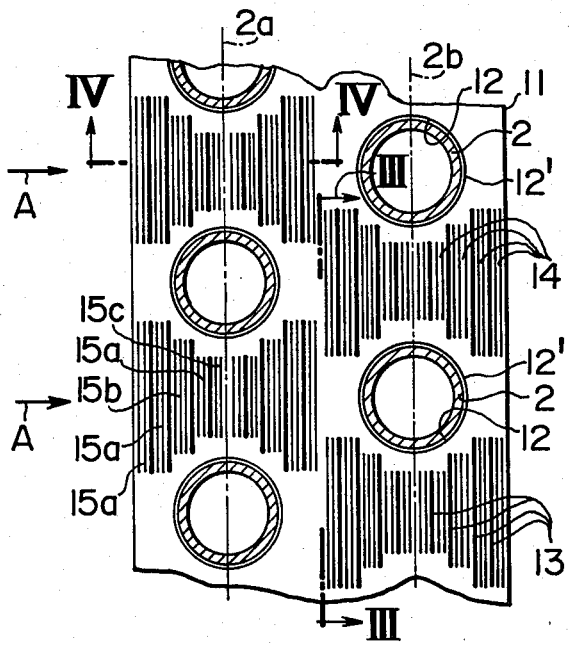
FIG. 2 is a fragmentary plan view of the fin plate used in the heat exchanger shown in FIG. 1 wherein the stepped louvers of one form are formed and arranged in the form of waves on a fin plate having two rows of heat transfer tubes.
Figure 3:
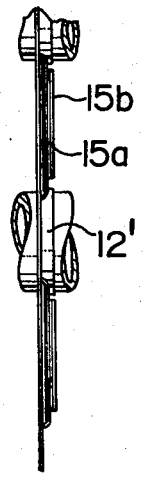
FIG. 3 is a sectional view taken along the line III—III in FIG. 2, showing a single fin plate.
Figure 4:
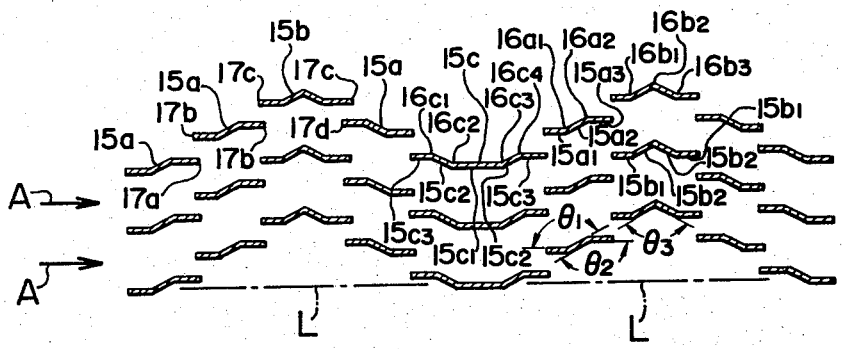
FIG. 4 is a sectional view, on an enlarged scale, taken along the line IV—IV in FIG. 2.

FIGS. 2 and 3 show a flat fin plate 11 formed with a plurality of heat transfer tube receiving holes 12 arranged in two rows 2*a* and 2*b* in such a manner that the holes 12 of the two rows 2*a* and 2*b* are offset. The holes 12 which are each formed with a collar 12′ at the edge have heat transfer tubes 2 passing therethrough. Made in the wall of the fin plate 11 interposed between the adjacent two heat transfer tube receiving holes 12 in each of the rows 2*a* and 2*b* of the heat transfer tubes 2 are a multiplicity of cuts 13 suitably spaced apart from one another and located parallel to the direction (substantially in the direction of the rows 2*a* and 2*b*) at right angles to the direction of air flow across the fin plates 11 as indicated by arrows A in FIG. 2. The cuts 13 provide thin strips 14 which are formed into three types of stepped louvers 15*a*, 15*b* and 15*c* as shown in FIG. 4. In their essential forms, the louvers 15*a* are each composed of a lower wall 15*a*1, a rise wall 15*a*2 and an upper wall 15*a*3 formed by dividing each thin strip 14 into three portions. The lower wall 15*a*1 extends parallel to the direction in which the fin plate 11 extends as indicated by a dash-and-dot line L in FIG. 4. The lower wall 15*a*1 is contiguous with the rise wall 15*a*2 bent at an angle $\theta_1$ and tilting which terminates in the upper wall 15*a*3 bent at an angle $\theta_2$ and disposed parallel to the direction of the line L in which the fin plate 11 extends. Two ridges 16*a*1 and 16*a*2 are formed between the lower wall 15*a*1 and rise wall 15*a*2 and between the rise wall 15*a*2 and upper wall 15*a*3 respectively to provide a first type of louver 15*a*.

A second type of louver 15*b* is composed of a lower wall 15*b*1 and a rise wall 15*b*2 which are contiguous with a rise wall 15*b*1 and a lower wall 15*b*2 so as to be arranged in angled form, with the two rise walls 15*b*2 and 15*b*2 forming an angle $\theta_3$. Three ridges 16*b*1, 16*b*2 and 16*b*3 are formed between the lower wall 15*b*1 and rise wall 15*b*2, between the two rise walls 15*b*2 and 15*b*2 and between the rise wall 15*b*2 and lower wall 15*b*1, respectively, to provide the second type of louver 15*b*.

A third type of louver 15*c* includes an intermediate wall 15*c*1 of a large width contiguous at either end thereof with a rise portion 15*c*2 and an upper wall 15*c*3, so that the two sets of rise wall 15*c*2 and upper wall 15*c*3 are arranged symmetrically on the left and right of the intermediate wall 15*c*1 in the form of a valley. Four ridges 16*c*1, 16*c*2, 16*c*3 and 16*c*4 are formed between the upper wall 15*c*3 and rise wall 15*c*2, between the rise wall 15*c*2 and intermediate wall 15*c*1, between the intermediate wall 15*c*1 and rise wall 15*c*2 and between the rise wall 15*c*2 and upper wall 15*c*3, respectively, to provide the third type of stepped louver 15*c*.

The three types of stepped louvers 15*a*, 15*b* and 15*c* of the aforesaid construction are arranged as shown in FIGS. 2–4. The stepped louvers 15 in suitable positions are raised in bridge fashion to suitable vertical levels while being disposed parallel to the fin plate, so that the group of louvers interposed between the two adjacent heat transfer tubes of the same row are arranged in different vertical positions in the form of waves oriented in the direction in which the fin plate extends. The adjacent stepped louvers have edges 17*a*, 17*b* . . . which vary in their vertical positions.

Operation of a cross finned tube heat exchanger of the aforesaid construction will be described by referring to FIG. 5. Air flows into the heat exchanger as indicated by arrows A and is branched into air currents each flowing across the surfaces of the fin plates as indicated by arrows a. Each fin plate is formed with a group of stepped louvers 15*a*, 15*b*, 15*c* . . . extending in a direction (parallel to the rows of heat transfer tubes) substantially at right angles to the direction of air flow, so that the air flow across the surfaces of the fin plates is guided, and has its path bent by the stepped louvers 15*a*, 15*b*, 15*c* . . . The air flow is stripped off the louvers 15*b* as indicated at 18 in the $\theta_3$ angled wall portions of the stepped louvers 15*b*. Thus, each air current flows in turbulent flow, and the boundary layers of air flow formed along the stepped louvers 15*a*, 15*b*, 15*c* . . . as indicated at 19 (shown only with the louvers of the uppermost layer in FIG. 5) or the boundary layers of temperature are unable to grow in going from the front end to the rear end of each louver. The growth of the boundary layers of temperature into fully developed layers is inhibited in this way and, consequently, each temperature boundary layer 19 formed on the surface of each stepped louver is very small in thickness.

The adjacent stepped louvers 15*a*, 15*b* and 15*c* have edges 17*a*, 17*b*, 17*c* . . . which vary from one another in vertical heights. The absence of the edge of the next following stepped louver at the same level as the rear edge of each stepped louver of each layer puts an end to the growth of the temperature boundary layer formed on the surface of each stepped louver, with a result that the residual temperature boundary layer disappears with a small trail being left in the air.

In the embodiment shown in FIG. 5, air currents flow across the surfaces of the fin plates in an air flow pattern described hereinabove. By virtue of the air flow pattern specifically obtained with the heat exchanger according to the invention, each stepped louver can positively exhibit the so-called "leading edge effect" of the louver wherein the front edge of each louver cuts an air current, and at the same time the temperature boundary layer formed on the surface of each stepped louver can have its thickness reduced, thereby enabling the efficiency of heat exchange occurring between the fins formed with the stepped louvers and the air currents flowing across the surfaces of the fin plates to be greatly increased.

Each stepped louver is formed with at least two ridges 16. More specifically, the first type of louver 15*a* is formed with two ridges 16*a*1 and 16*a*2; the second type of louver 15*b* is formed with three ridges 16*b*1, 16*b*2 and 16*b*3; and the third type of louver 15*c* is formed with four ridges 16*c*1, 16*c*2, 16*c*3 and 16*c*4. This markedly increases the flexural rigidity of each fin plate in the direction in which the heat transfer tube rows are oriented and facilitates assembling of the heat exchanger, so that the thickness of each fin plate can be reduced and material cost of the heat exchanger can be reduced.

In the aforesaid arrangement of the stepped louvers in the form of waves, the louvers 15*b* disposed at the top of each wave and the louvers 15*c* disposed at the bottom of each wave differ from one another in configuration. The louvers disposed at the bottom of each wave may be the second type of louvers 15*b* in upside down position, and the louvers disposed at the top of each wave may be the third type of louvers 15*c* in upside down position.

Figure 5:
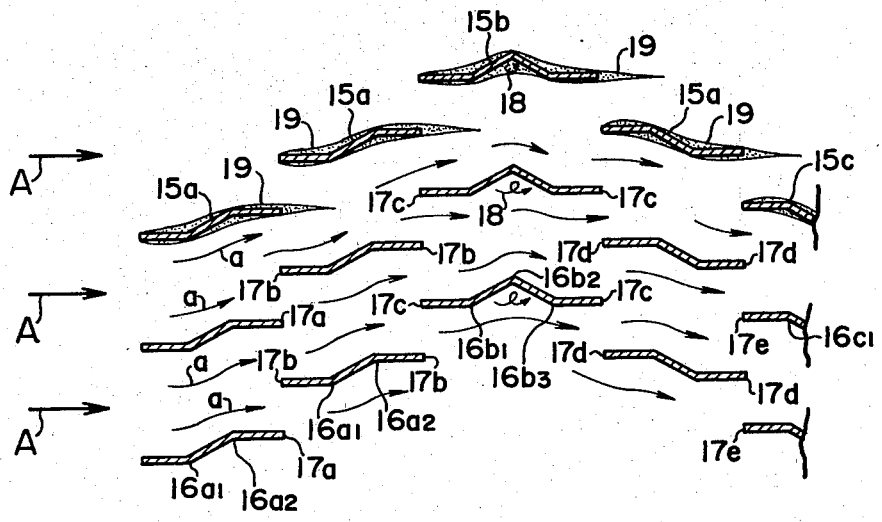
FIG. 5 is a fragmentary enlarged view of FIG. 4, showing the manner in which the external air flows through the louvers.
Figure 7:
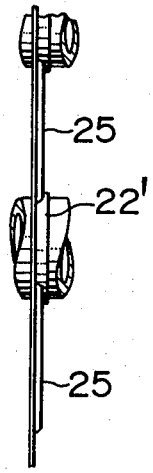
FIG. 7 is a sectional view taken along the line VII—VII in FIG. 6.
Figure 8:
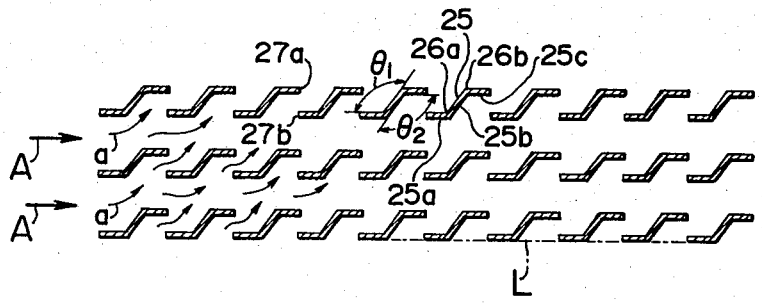
FIG. 8 is a sectional view, on an enlarged scale, taken along the line VIII—VIII in FIG. 6.

In the embodiment shown in FIG. 5, the group of stepped louvers on each fin plate is arranged in the form of waves. The invention is not limited to this pattern of arrangement of the stepped louvers, and the stepped louvers may be arranged at the same vertical height, as shown in FIGS. 6–8.

Figure 6:
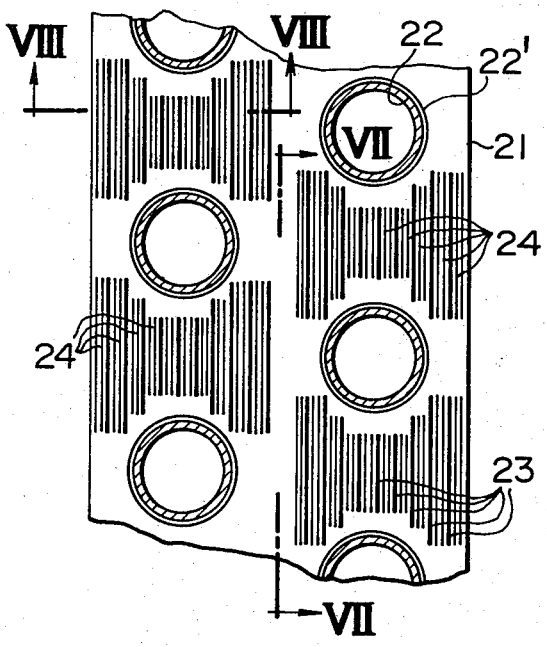
FIG. 6 is a fragmentary plan view of the fin plate, wherein the stepped louvers are arranged to have a uniform height with respect to the direction in which the fin plates extend.

Referring to FIG. 6, heat transfer tube inserting openings 21 are formed in the flat fin plate 21, a collar 22' is formed at the edge of each opening 22 and a multiplicity of cuts 23 are made in the fin plate 21 in the same manner as described by referring to FIG. 2. However, in the emboidment shown in FIG. 6, the cuts 23 are equidistantly spaced apart from one another to form thin strips 24 of the same width. As shown in FIG. 8, the thin strips 24 are bent to provide stepped louvers 25 of substantially the same shape as the first type of stepped louvers 15 shown in FIG. 4. That is, each thin strip 24 is divided into three portions of substantially equal size or a lower wall 25*a*, a rise wall 25*b* and an upper wall 25*c* contiguous with one another. The lower wall 25*a* is flush with the surface of the fin plate 21 and forms an angle $\theta_1$ with the rise wall 25*b* forming an angle $\theta_2$ with the upper wall 25*c* which is parallel to the direction L in which fin plate 21 extends, so that the louver 25 is stepped at two ridges 26*a* and 26*b*. The stepped louvers 25 formed on the fin plate 21 are arranged at the same height, and the adjacent stepped louvers 25 have edges 17*a*, 17*b* . . . which vary in their vertical positions. The embodiment of the invention provided with the stepped louvers of the aforesaid construction operates in the same manner as the embodiment described by referring to FIGS. 2–4. That is, air flowing into the heat exchanger in the direction indicated by arrows A is branched into air currents a each flowing across the two adjacent fin plates. The air current a flowing through the path of flow between the surfaces of the fin plates 21 is guided by the stepped louvers 25 and its path of flow is bent, to form a turbulent air flow. The temperature boundary layer formed on the surface of each stepped louver 25 is prevented from growing and its thickness remains very small with the trail of the temperature boundary layer at the rear edge of each stepped louver 25 disappearing without being connected to the temperature boundary layer at the front edge of the next following stepped louver 25. Thus, the front edge of each stepped louver 25 positively exhibits the leading edge effect by cutting the air current while the temperature boundary layer formed on the surface of each stepped louver 25 is very small in thickness, to thereby greatly increase the efficiency with which heat exchange is effected between the air flowing across the surfaces of the fin plates 21 and the fluid flowing through the heat transfer tubes 22 through the fin plates 21.

The stepped louvers 25 are oriented in the direction of the rows of heat transfer tubes 22 and formed with two ridges 25*a* and 26*b* at the bends, so that the flexural rigidity of each fin plate 21 longitudinally of the rows of heat transfer tubes 22 is greatly increased.

Figure 9:
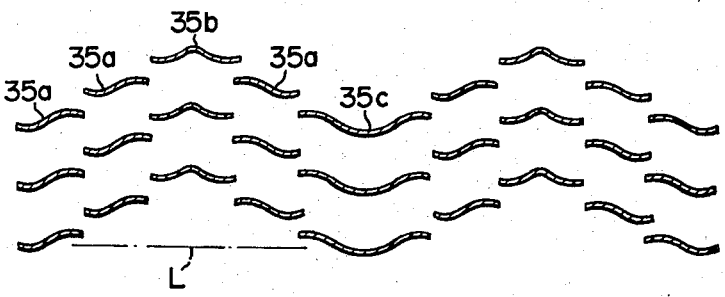
FIG. 9 is a sectional view, on an enlarged scale, of the stepped louvers of a modified form wherein the stepped louvers are curved and arranged in the form of waves.
Figure 10:
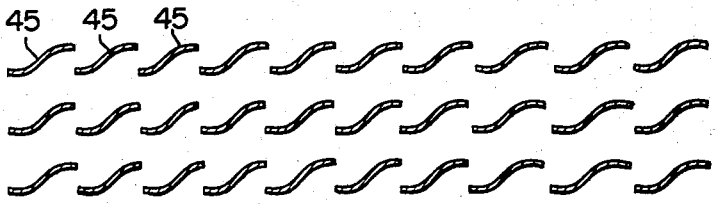
FIG. 10 is a sectional view, on an enlarged scale, of the stepped louvers of another modified form wherein the stepped louvers are curved and arranged to have a uniform height with respect to the direction in which the fin plates extend.

In the two embodiments shown and described hereinabove, the stepped louvers 15 (25) are bent into walls forming angles $\theta_1$, $\theta_2$ and $\theta_3$ so that each louver has ridges. The invention is not limited to this specific form of the louvers, and the louvers may be curved, not bent, when formed into stepped louvers. FIGS. 9 and 10 show embodiments wherein the stepped louvers are not bent but curved.

In FIG. 9, the fin plates are shown in the same section as the fin plates shown in FIG. 4, and formed with stepped louvers 35*a*, 35*b* and 35*c* of the curved form. The embodiment of FIG. 9 is similar to the embodiment of FIG. 4 in that the stepped louvers are arranged in the form of waves with respect to the direction L in which the fin plates extend and that the adjacent louvers have edges varying in vertical positions. In this embodiment, the resistance offered to the flow of a heat transfer medium across the surfaces of the fin plates is smaller than in the embodiment shown in FIG. 4. However, the operation of the heat exchanger shown in FIG. 9 and the effects achieved thereby are substantially similar to those of the embodiment shown in FIG. 4.

The fin plates shown in FIG. 9 have substantially the same flexural rigidity as the fin plates shown in FIG. 4 because the stepped louvers 35 have at least two curvings of different directions in place of the two ridges.

FIG. 10 shows stepped louvers 45 of the curved form in the same section as FIG. 8. Except for the fact that the stepped louvers 45 are of the curved form, they are similar to the stepped louvers 25 shown in FIG. 8 in that they are arranged at the same vertical height and that the adjacent stepped louvers 45 have edges varying from one another in vertical positions. The operation of, and the effects achieved in operation by the stepped louvers 45 are substantially similar to those of the stepped louvers 25.

The stepped louvers 45 having two curvings of different directions formed therein in place of the two ridges, the fin plates shown in FIG. 10 have substantially the same flexural rigidity longitudinally of the rows of the heat transfer tubes as the fin plates shown in FIG. 8.

In all the embodiments shown and described hereinabove, the fin plates are formed with heat transfer tube receiving holes arranged in two rows in such a manner that the holes of the two rows are offset. It is to be understood that the invention can have application in fin plates formed with only one row of heat transfer tube receiving openings or over three rows thereof.

Figure 11:
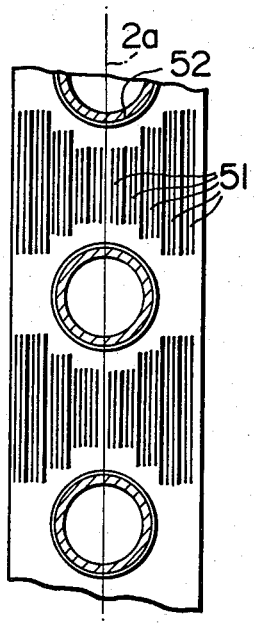
FIGS. 11 and 12 show other embodiments, FIG. 11 being a plan view of the fin plate having one row of heat transfer tubes and FIG. 12 being a fragmentary plan view of the fin plate having more than three rows of heat transfer tubes.

FIG. 11 shows a fin plate having only one row 2*a* of heat transfer tube receiving holes 52 wherein stepped louvers 51 are formed in the same manner as described by referring to the previously described embodiments on the wall of the fin plate between the heat transfer tube receiving holes 52.

Figure 12:
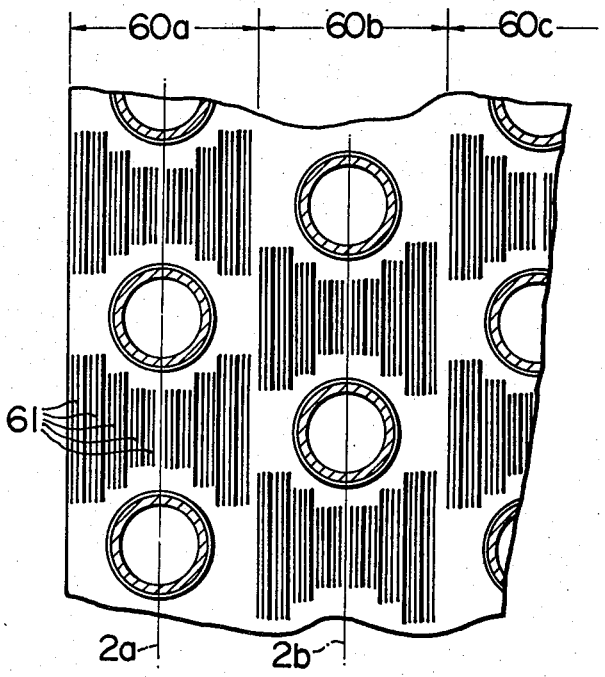

In FIG. 12, there is shown a fin plate having more than three rows 2*a*, 2*b*, 2*c* . . . of heat transfer tube receiving holes wherein the heat transfer tube receiving holes of the adjacent rows are offset and the stepped louvers 61 of the same construction as described by referring to the embodiments are formed on the wall of the fin plate between the heat transfer tube receiving holes of the same row. The number of the rows of heat transfer tube receiving holes may be increased as desired by adding fin plate units of the desired number to the fin plate units 60*a*, 60*b* and 60*c*.

What is claimed is:

1. A cross finned tube heat exchanger comprising:

a multiplicity of fin plates of a suitable area arranged in substantially parallel, closely spaced relation; and a plurality of heat transfer tubes passing through aligned openings in said fin plates and kept in intimate contact with said fin plates to allow a heat transfer medium flowing through said heat transfer tubes to exchange heat with another heat transfer medium flowing across the surfaces of said fin plates; wherein the improvement comprises:

a multiplicity of stepped louvers formed on a wall of each fin plate between the adjacent heat transfer tubes of the same row, said stepped louvers having, in a direction substantially at right angles to a direction of flow of the heat transfer medium across the surfaces of the fin plates, thin strips of substantially similar width, said thin strips being formed from the plane of each of said fin plates into stepped louvers generally at right angles to the direction of flow with said another heat transfer medium, said stepped louvers having at least two walls disposed substantially parallel to one another and at least one tilting rise wall connecting said at least two walls, said strips connected at their ends to each of said plates said stepped louvers each having a rear edge varying in vertical position from a front edge of the next following stepped louver in a given row.

2. A cross finned tube heat exchanger as claimed in claim 1, wherein said heat transfer tubes are arranged only in one row.

3. A cross finned tube heat exchanger as claimed in claim 1, wherein said heat transfer tubes are arranged in over two rows and the heat transfer tubes of the adjacent rows are offset.

4. A cross finned tube heat exchanger as claimed in claim 1, wherein the stepped louvers formed on each of said fin plates are located at a same vertical height with respect to a direction in which the fin plate extends.

5. A cross finned tube heat exchanger as claimed in claim 1, wherein a group of said louvers formed on each of said fin plates is arranged in the form of waves with respect to a direction in which the fin plate extends.

6. A cross finned tube heat exchanger as claimed in claim 5, wherein the stepped louvers disposed at the top and bottom of the wave form are symmetrical in cross-sectional shape.

7. A cross finned tube heat exchanger as claimed in claim 5, wherein a stepped louver disposed at the top and bottom of the wave form each include tilting rise walls arranged symmetrically in cross section.

8. A cross finned tube heat exchanger as claimed in claim 1, wherein said stepped louvers are curved.

* * * * *